US005160423A

United States Patent [19]

Yokoi

[11] Patent Number: 5,160,423

[45] Date of Patent: * Nov. 3, 1992

[54] NICKEL PLATING SOLUTION, NICKEL-CHROMIUM ELECTROPLATING METHOD AND NICKEL-CHROMIUM PLATING FILM

[75] Inventor: Hiroshi Yokoi, Odawara, Japan

[73] Assignee: Kanto Kasei Co., Ltd., Yokosuka, Japan

[ * ] Notice: The portion of the term of this patent subsequent to Oct. 2, 2007 has been disclaimed.

[21] Appl. No.: 606,024

[22] Filed: Oct. 30, 1990

[30] Foreign Application Priority Data

Nov. 9, 1989 [JP] Japan ..... 1-292086

[51] Int. Cl.[5] ..... C25D 3/12; C25D 3/56

[52] U.S. Cl. ..... 205/255; 205/271

[58] Field of Search ..... 204/41, 49; 205/255, 205/239, 271

[56] References Cited

U.S. PATENT DOCUMENTS

| | | | |
|---|---|---|---|
| 3,152,973 | 10/1964 | Tomaszewski et al. | 204/41 |
| 3,449,223 | 6/1969 | Odekerken | 204/41 |
| 3,625,039 | 12/1971 | Kubach | 204/41 |
| 3,866,289 | 2/1975 | Brown et al. | 204/41 |
| 4,960,653 | 10/1990 | Yokoi | 204/41 |

*Primary Examiner*—John Niebling
*Assistant Examiner*—Brian M. Bolam
*Attorney, Agent, or Firm*—Fulbright & Jaworski

[57] ABSTRACT

The present invention relates to a nickel plating solution to which a salt of an element in Group IIa in the periodic table is added, a method of copper-nickel-chromium or nickel-chromium bright electroplating and a film obtained by such a plating method. The nickel plating film is a bright electroplating film having excellent corrosion resistance.

5 Claims, 1 Drawing Sheet

NICKEL PLATING SOLUTION, NICKEL-CHROMIUM ELECTROPLATING METHOD AND NICKEL-CHROMIUM PLATING FILM

BACKGROUND OF THE INVENTION

The present invention relates to a nickel plating solution to which a salt of an element in Group IIa in the periodic table is added, a method of copper-nickel-chromium or nickel-chromium bright electroplating and a film obtained by such a plating method. The nickel plating film is a bright electroplating film having excellent corrosion resistance.

Copper-nickel-chromium plating or nickel-chromium plating with excellent corrosion resistance is frequently made on the surfaces of automobile cars, electrical products and parts thereof for the purpose of improving the corrosion resistance of the basic materials and improving the decorative effect by combination with decorating.

However, since flaws or cracks easily occur in the chromium surface platings obtained by such copper-nickel-chromium plating or nickel-chromium plating, corrosion is significantly progressed to the insides of the platings from the defective portions in the surfaces due to the presence of the flaws or cracks. This corrosion rapidly proceeds and finally reaches the basic materials because of the small anode area (nickel) and high corrosion current density. There is thus a great possibility that the corrosion of the basic materials brings about the occurrence of not only defects in the appearances but also fatal defects.

In order to cope with this problem, therefore, the thickness of each metal deposit is increased, or a plurality of deposits of each metal are laminated. However, such a method has a problem from the viewpoints of effective utilization of resources and cost.

The specification of Japanese Patent Publication No. 56-15471 discloses a corrosion-resistant metal film which is obtained by nickel plating using a semi-bright nickel plating and bright nickel plating solutions to each of which a brightener and a wetting agent are added, and a nickel plating solution to which a soluble amine compound and a metal selected from Groups III, V and VI in the periodic table, preferably aluminum or chromium, is added, so that fine particles are deposited on the nickel plating; and then chromium plating the nickel plating so that the local corrosion current density is decreased by the formation of micropores in the surface of the chromium plating, thereby improving the corrosion resistance.

The aforementioned prior art also has problems in that plating must be effected within a narrow control range for preventing the occurrence of dulling on the film formed after chromium plating and in that yellowing detrimental to plating occurs if the amount of the metal ions added exceeds 0.5 g/l, and such detrimental substance must be removed.

SUMMARY OF THE INVENTION

It is an object of the present invention to provide a nickel plating solution which permits the solution of all the above-described problems of prior art, a method of copper-nickel-chromium electroplating or nickel-chromium electroplating using the plating solution and a plating film obtained by the nickel-chromium or copper-nickel-chromium electroplating method.

It is a first object of the present invention to provide a nickel plating solution which contains nickel or a nickel salt and 0.5 to 20 g/l of salt of an element in Group IIa in the periodic table.

It is a second object of the present invention to provide a copper-nickel-chromium bright electroplating method or a nickel-chromium bright electroplating method comprising the steps of nickel eutectoid plating with a thickness of 0.2 to 50 μm using as a nickel plating bath a nickel plating solution containing nickel or a nickel salt and 0.5 to 20 g/l of salt of an element of Group IIa in the periodic table during copper-nickel-chromium electroplating or nickel-chromium electroplating on a basis material; and then chromium plating with a thickness of 0.1 to 1.0 μm to form a plating having excellent corrosion resistance.

It is a third object of the present invention to provide a copper-nickel-chromium or nickel-chromium bright electroplating film with excellent corrosion resistance which is formed by the copper-nickel-chromium electroplating method or the nickel-chromium electroplating method provided by the second object, which has a thickness of 0.2 to 50 μm, micropores and the copper and nickel layers formed on the basis material or the nickel layer formed directly on the basis material by eutectoid plating.

DETAILED DESCRIPTION OF THE INVENTION

Figure 1:
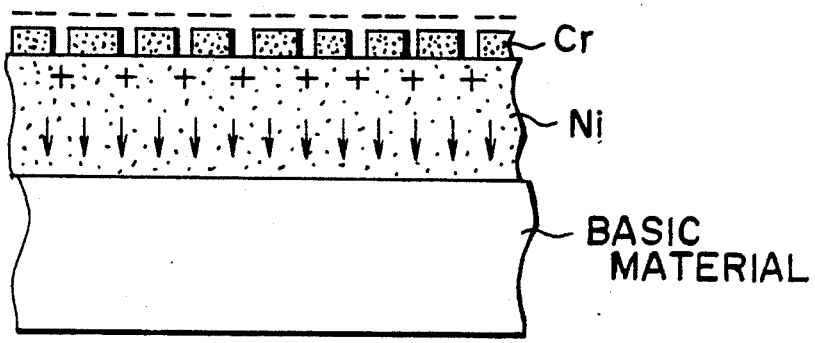
FIG. 1 is an explanatory view which shows the corrosion mechanism in a plating film in accordance with the present invention.

As a result of research performed by the inventor with a view to solving the above-described problems of prior art, the inventor discovered a copper-nickel-chromium or nickel-chromium electroplating method of forming bright electroplating film with excellent corrosion resistance, comprising the steps of eutectoid plating with a thickness of 0.2 to 50 μm by using as a nickel plating bath a nickel plating solution containing nickel or a nickel salt and 0.2 to 50 g/l of salt of an element in Group IIa in the periodic table; and then chromium plating with a thickness of 0.1 to 1.0 μm.

The nickel plating solution contained in the present invention is obtained by adding 0.5 to 20 g/l of one, two or three salts of elements in Group IIa in the periodic table to a Watts bath, a Weisberg bath, a sulfamate bath or a chloride bath.

The nickel or nickel salt used in the nickel plating solution of the present invention is nickel or a nickel salt of the type that is generally used in nickel plating. Examples of nickel salts include nickel chloride, nickel sulfate, nickel sulfamate and the like.

Examples of salts of elements in Group IIa in the periodic table include beryllium salts such as beryllium oxide, beryllium sulfate and the like; magnesium salts such as magnesium chloride, magnesium oxide, magnesium hydroxide, magnesium phosphate, magnesium carbonate, magnesium nitrate, magnesium sulfate, magnesium acetate, magnesium bromide, magnesium fluoride, magnesium silicate and the like; calcium salts such as calcium chloride, calcium hydroxide, calcium carbonate, calcium nitrate, calcium acetate, calcium phosphate, calcium bromide, calcium carbide, calcium fluoride, calcium iodide, calcium oxalate, calcium silicate and the like; strontium salts such as strontium hydroxide, strontium oxalate, strontium chromate, strontium oxide, strontium carbonate, strontium sulfate, strontium nitrate, strontium chloride, strontium acetate, strontium fluoride and the like; barium salts such as barium chloride, barium sulfate, barium nitrate, barium carbonate, barium sulfate, barium hydroxide, barium oxide, barium fluoride, barium acetate, barium formate, barium iodide, barium phosphate and the like.

Strontium salts and calcium salts are preferable, and strontium chloride and calcium carbonate are more preferable.

If the adding amount of the element in Group IIa in the periodic table is 0.5 g/l or less, no effectiveness is recognized. If the amount is 20 g/l or more, the salt of the same element settles out and adheres to the heating tube and the electrode plates in the plating tank used. This causes the deteriorate in thermal efficiency, electrodeposition efficiency and appearance of the film formed. A eutectoid of a salt of any one of the above elements is formed on the film obtained by nickel plating using the plating solution of the present invention, and micropores are formed in the film obtained after chromium plating on the nickel film.

Examples of plating basis materials that may be used in the present invention include basis materials of metals such as iron, copper, zinc, aluminum and the like; and various resins such as ABS resins (acrylonitrile-butadiene-styrene resins), PPO resins (polyphenyleneoxide resins), polyacetal resins, polyamide resins, polycarbonate resins, PP resins (polypropylene resins), PPS resins (polyphenylene sulfide resins), epoxy resins and the like, all of which resins are made conductive by predetermined treatment.

Pretreatment of a metal basis material such as an iron material or the like is performed by a usual pretreatment method, for example, comprising the following steps:

(1) Abrasion of basis material (2) Hanging (a material to be plated is hung on a plating jig)

(3) Washing (washing by immersion in an alkali, acid or alkali electrolysis, a solvent or degreasing)

(4) Acid immersion (treatment using an acid selected from the group consisting of hydrochloric acid, sulfuric acid, fluoric acid, nitric acid and the like in correspondence with the basis material used)

(5) Metal substitution (depending upon the kind of the metal used, for example, in a case of aluminum, the surface of aluminum is substituted by a zinc salt)

If required, a washing step is interposed between the respective steps.

When a resin basis material is used, pretreatment is effected by a usual pretreatment, for example, comprising the following steps:

(1) Molding (2) Hanging (3) Washing (washing by immersion in an alkali or acid or degreasing treatment)

(4) Pre-etching (for example, PP resin is sometimes treated with xylol or the like for 15 to 20 minutes under heating)

(5) Etching (treatment with chromic anhydride and sulfuric acid under heating)

(6) Catalyzation (treatment with stannous chloride and hydrochloric acid at room temperature)

(7) Activation (palladium chloride and hydrochloric acid at room temperature)

(8) Chemical plating (plating with chemical copper and chemical nickel)

If required, a washing step is interposed between the respective steps.

In the present invention, copper-nickel-chromium electroplating on the basic material is basically carried out by a general method. However, the method of the present invention is characterized by using as a nickel plating solution the above-described nickel plating solution of the present invention.

The method of copper-nickel-chromium electroplating the basis material which is previously treated by the abovementioned pretreatment method, for example, comprises the following steps:

(1) Acid or alkali immersion (2) Copper strike electroplating (3) Copper electroplating (4) Nickel electroplating (5) Chromium electroplating In Step (1) of acid or alkali immersion, the basis material which is previously subjected to the above-described pretreatment is activated by immersing it in a 1 to 5 wt % solution of a mineral acid such as sulfuric acid, hydrochloric acid or the like or a 1 to 5 wt % solution of an alkali such as sodium hydroxide or the like. The treatment time is about 1 to 5 minutes.

The basis material which is subjected to the treatment is preferably washed with water and then supplied to the next Step (2).

In Step (2) of copper strike electroplating, a thin copper plating film having good adhesion is formed on the basis material by a general strike plating method using copper pyrophosphate under the condition of a cathode current density of 1 to 5 $A/Cm^2$.

In Step (3), copper electroplating is effected by using a general acid bath containing copper sulfate and sulfuric acid. An alkali bath or a bath obtained by dissolving copper cyanide in an alkali cyanide may be used.

In this case, a brightener such as thiourea, sodium 5-naphthalenedisulfonate, 2-butyne-1,4-diol, gelatin, glue, dextrin or the like; or a semi-brightener may be added to the plating bath by a normal method so that brightness or semi-brightness can be obtained.

Step (4) of nickel electroplating is a characteristic step of the present invention in which electroplating is first effected by a general nickel electroplating method using a nickel plating bath such as a Watts bath (nickel sulfate, nickel chloride, boric acid), a Weisberg bath (nickel sulfate, cobalt sulfate, boric acid, nickel chloride), a sulfamate acid bath (nickel sulfamate, boric acid), a chloride bath (nickel chloride, boric acid) or the like. Nickel electroplating is then performed by using a nickel plating bath of the present invention obtained by adding a 0.5 to 20 g/l of salt of an element in Group IIa in the periodic table to the above nickel plating bath. Alternatively, nickel electroplating on the basis material plated with copper in Step (3) is directly performed by using the nickel plating bath of the present invention, without general nickel electroplating being previously made. In this case, the thickness of the nickel deposit formed is 2 to 50 μm, preferably 1.0 μm.

A brightener may be added to the nickel plating bath.

In Step (5), chromium electroplating is performed by a general plating method, for example, using a chromium bath obtained by adding at least one of sulfuric acid, hydrogen fluoride, ammonium fluoride and silicofluorides to anhydrous chromium oxide to form a chromium deposit with a thickness of 0.1 to 1.0 μm on the nickel deposit.

A water washing step may be interposed between the respective steps.

In the present invention, although nickel-chromium electroplating on the basis material is basically performed by a normal method, the method of the present invention is characterized by using as a nickel plating bath the above-described nickel plating bath of the present invention.

The nickel-chromium plating on the basis material which is previously subjected to the pretreatment is effected by a general nickel-chromium electroplating method, for example, comprising the following steps:

(1) Acid or alkali immersion
(2) Nickel electroplating
(3) Chromium electroplating Steps (1), (2) and (3) in the method are respectively performed by the same methods as those of the above-described Steps (1), (4) and (5).

The film obtained by the method of the present invention comprises a nickel deposit which is formed on the basis material so that fine particles of a eutectoid of the salt of the element in Group IIa in the periodic table, which is contained in the nickel plating bath, are dispersed therein; and a chromium deposit which is formed on the upper surface of the nickel deposit and has a thickness of 0.1 to 1.0 μm, the surface chromium deposit having micropores in the surface thereof.

Figure 2:
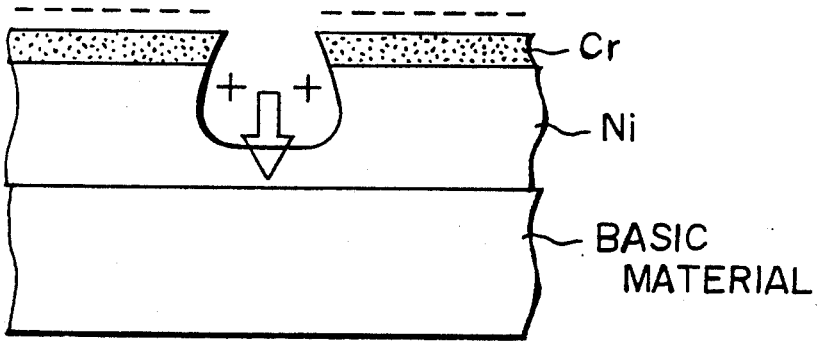
FIG. 2 is a drawing which shows the corrosion mechanism in a conventional plating film.

In the deposit formed by a conventional plating method shown in FIG. 2, local cells are formed in portions where flaws or cracks occur and thus produce electrolytic reaction therein. This reaction causes not only the significant dissolution of nickel due to a small cathode (nickel) area but also the dissolution of the basis material metal. There is thus a danger of creating fatal defects.

In the plating method in accordance with the present invention, the salt of the element in Group IIa in the periodic table, which is contained in the nickel plating bath, is dispersed or dissolved in the plating bath, and the eutectoid is produced in both forms of an element and a salt. As shown in FIG. 1, the local cells are dispersed by the micropores which are formed by the eutectoid of the metal added or the salt thereof so that the electromotive force and the dissolution of nickel can be reduced. In addition, the formation of the eutectoid of the element added causes the passivation of nickel and thus causes the control and prevention of dissolution of nickel and an improvement in corrosion resistance.

EXAMPLE

Examples of the present invention are described below.

Example 1

Copper-nickel-chromium electroplating was performed on a basic material of ABS resin, which had been subjected to predetermined pretreatment in accordance with the steps below.

| | |
|---|---|
| (1) Acid immersion | |
| Solution composition | |
| Sulfuric acid | 25-80 g/l |
| Bath temperature | room temperature |

-continued

| | |
|---|---|
| Immersion | 5 seconds-1 minute |
| Water washing | |
| (2) Copper strike plating | |
| Solution composition | |
| Copper pyrophosphate trihydrate | 15-25 g/l |
| Potassium pyrophosphate | 60-100 g/l |
| Potassium oxalate | 10 15 g/l |
| P ratio | 11-13 |
| Bath temperature | 40-50° C. |
| pH | 8-9 |
| Average cathode current density | 1-5 A/Cm$^2$ |
| Agitation | air agitation |
| Water washing | |
| (3) Acid immersion | |
| Solution composition | |
| Sulfuric acid | 30-60 g/l |
| Bath temperature | room temperature |
| Immersion | 5 seconds-1 minute |
| (4) Copper plating | |
| Solution composition | |
| Copper sulfate pentahydrate | 150-200 g/l |
| Sulfuric acid | 50-90 g/l |
| Hydrochloric acid | 40-100 g/l |
| Primary brightener (thiourea) | 3-7 ml/l |
| Secondary brightener (dextrin) | 0.5-1 ml/l |
| Bath temperature | 15-25° C. |
| Average cathode current density | 1-5 A/dm$^2$ |
| Agitation | air agitation |
| (5) Acid immersion | |
| Solution composition | |
| Hydrochloric acid | 5-10 g/l |
| Bath temperature | room temperature |
| Immersion | 30 seconds-1 minute |
| (6) Semi-bright nickel plating | |
| Solution composition | |
| Nickel sulfate hexahydrate | 250-350 g/l |
| Nickel chloride hexahydrate | 35-50 g/l |
| Boric acid | 30-60 g/l |
| Brightener (sodium 5-naphthalenedisulfonate) | 0.1-0.2 g/l |
| Bath temperature | 40-60° C. |
| pH | 3.5-4.5 |
| Average cathode current density | 1-5 A/dm$^2$ |
| Agitation | air agitation |
| Water washing | |
| (7) Bright nickel plating | |
| Solution composition | |
| Nickel sulfate hexahydrate | 250-360 g/l |
| Nickel chloride hexahydrate | 35-60 g/l |
| Boric acid | 30-50 g/l |
| Primary brightener (sodium 1,5-naphthalenedisulfonate | 5-40 g/l |
| Secondary brightener (2-butyne-1,4-diol) | 0.1-10 g/l |
| Bath temperature | 40-60° C. |
| pH | 3.5-4.5 |
| Average cathode current density | 1-5 A/dm$^2$ |
| Agitation | air agitation |
| Water washing | |
| (8) Nickel plating using the nickel solution of the present invention | |
| Solution composition | |
| Nickel sulfate hexahydrate | 300 g/l |
| Nickel chloride hexahydrate | 60 g/l |
| Boric acid | 40 g/l |
| Calcium carbonate | 2 g/l |
| Strontium chloride | 1 g/l |
| Bath temperature | 50-60° C. |
| pH | 3.8-4.5 |
| Average cathode current density | 1-5 A/dm$^2$ |
| Agitation | air agitation |
| Thickness | 2 μm |
| (9) Chromium plating | |
| Solution composition | |
| Chromic anhydride | 15-400 g/l |
| Sulfuric acid | 0.5-4 g/l |
| Silicofluoride | 0.5-10 g/l |
| Bath temperature | 35-55° C. |
| Average cathode current density | 5-25 A/Cm$^2$ |
| Water washing | |

-continued

| |
|---|
| The plating film obtained had good bright appearance. |

Example 2

Plating was carried out by the same method as in Example 1 with the exception that the solution composition and the conditions of step (8) of Example 1 were changed as described below.

| | |
|---|---|
| Solution composition | |
| Nickel sulfate hexahydrate | 220 g/l |
| Nickel chloride hexahydrate | 40 g/l |
| Boric acid | 40 g/l |
| Calcium carbonate | 5 g/l |
| Strontium chloride | 3 g/l |
| Bath temperature | 50-60° C. |
| pH | 4.5-5.0 |
| Average cathode current density | 0.5-4 A/dm$^2$ |
| Agitation | air agitation |
| Thickness | 0.2 μm |

The plating film obtained had micropores and good bright appearance.

Example 3

Nickel-chromium electroplating was performed on the basic material, which had been subjected to the predetermined pretreatment, in accordance with the following steps:

| | |
|---|---|
| (1) Acid immersion | |
| Solution composition | |
| Sulfuric acid | 25-80 g/l |
| Bath temperature | room temperature |
| Immersion | 5 seconds to 1 minute |
| Water washing | |
| (2) Semi-bright nickel plating | |
| Solution composition | |
| Nickel sulfate hexahydrate | 250-350 g/l |
| Nickel chloride hexahydrate | 35-50 g/l |
| Boric acid | 30-60 g/l |
| Brightener (sodium 5-naphthalenedisulfonate | 0.1-0.2 g/l |
| Bath temperature | 40-60° C. |
| pH | 3.5-4.5 |
| Average cathode current density | 1-5 A/dm$^2$ |
| Agitation | air agitation |
| Water washing | |
| (3) Bright nickel plating | |
| Solution composition | |
| Nickel sulfate hexahydrate | 250-360 g/l |
| Nickel chloride hexahydrate | 35-60 g/l |
| Boric acid | 30-50 g/l |
| Primary brightener (sodium 1,5-naphthalenedisulfonate) | 5-40 g/l |
| Secondary brightener (2-butyne-1,4-diol) | 0.1-10 g/l |
| Bath temperature | 40-60° C. |
| pH | 3.5-4.5 |
| Average cathode current density | 1-5 A/dm$^2$ |
| Agitation | air agitation |
| Water washing | |
| (4) Nickel plating using the nickel solution of the present invention | |
| Solution composition | |
| Nickel sulfate hexahydrate | 300 g/l |
| Nickel chloride hexahydrate | 60 g/l |
| Boric acid | 40 g/l |
| Calcium carbonate | 2 g/l |
| Strontium chloride | 1 g/l |
| Bath temperature | 50-60° C. |
| pH | 3.8-4.5 |
| Average cathode current density | 1-5 A/dm$^2$ |

-continued

| | |
|---|---|
| Agitation | air agitation |
| Thickness | 2 μm |
| Water washing | |
| (5) Chromium plating | |
| Solution composition | |
| Chromic anhydride | 150-400 g/l |
| Sulfuric acid | 0.5-4 g/l |
| Silicofluoride | 0.5-10 g/l |
| Bath temperature | 35-55° C. |
| Average cathode current density | 5-25 A/Cm$^2$ |
| Water washing | |

Example 4

Nickel plating was effected by the same method as in Example 1 with the exception that step (6) of Example 1 were removed and the solution compositions and the conditions of Steps (7) and (8) of Example 1 were changed as described below.

| | |
|---|---|
| (7)' Bright nickel plating (Weisberg bath) | |
| Solution composition | |
| Nickel sulfate hexahydrate | 240-300 g/l |
| Nickel chloride hexahydrate | 30-45 g/l |
| Boric acid | 30-40 g/l |
| Cobalt sulfate | 12-15 g/l |
| Formic acid | 25-30 g/l |
| Formalin | 1.5-2.5 g/l |
| Bath temperature | 55-60° C. |
| PH | 3.7-4.2 |
| Average cathode current density | 3-8 A/dm$^2$ |
| Agitation | air agitation |
| Water washing | |
| (8)' Nickel plating in accordance with the present invention | |
| Solution composition | |
| Nickel sulfate hexahydrate | 300 g/l |
| Nickel chloride hexahydrate | 60 g/l |
| Boric acid | 40 g/l |
| Calcium carbonate | 2 g/l |
| Strontium chloride | 1 g/l |
| Bath temperature | 50-60° C. |
| PH | 3.8-4.5 |
| Average cathode current density | 1-5 A/dm$^2$ |
| Agitation | air agitation |
| Thickness | 1 μm |

The plating film obtained had a reproducible substrate and good appearance with brightness.

The method of the present invention was compared with a conventional method in order to show that the film obtained by the method of the present invention has excellent properties.

The sample plated in Example 1 of the present invention was compared with the sample plated in Example 3-(d) (Comparative Example) of the specification of Japanese Patent Publication No. 56-15471, which was selected as a conventional method, by CASS tests in accordance with JISDO201 Appendix 2.

Comparative Example

| Bright nickel plating (Weisberg bath) | |
|---|---|
| Solution composition | |
| Nickel sulfate | 290.4 g/l |
| Nickel chloride | 62.5 g/l |
| Boric acid | 41.7 g/l |
| Brightener (a mixture containing saccharin (Na salt) and about 0.1 g of bis-benzenesulfonimide, | 1.5 wt % |

-continued

| Bright nickel plating (Weisberg bath) | |
|---|---|
| a mixture containing 2.1 g of sodium allylsulfonate and $C—CH_2O—C_2H_4O—C_2H_4SO_3Na$ $C—CH_2O—C_2H_4O—C_2H_4SO_3Na$ | 0.7 wt % |

Nickel plating was effected by using a solution having a pH value of 3, which was obtained by adding to the above plating solution 0.2 g/l of sodium diethylenetriaminepentaacetate, 12.5 mg/l of aluminum sulfate and 5 mg/l of chromium sulfate, at 60.0° too 62.8° C. under air agitation. Chromium plating was then effected.

TABLE 1

| Kind of Basis Material | Plating Condition (thickness, mm) Cu | SNi | BNi | Intermediate | Cr | CASS test after 32 h |
|---|---|---|---|---|---|---|
| Iron | — | 10 | 5 | Example 1 | 0.1 | 9.0 |
| Iron | — | 10 | 5 | Comparative Example | 0.1 | 6.5 |
| ABS resin | 10 | 10 | 5 | Example 1 | 0.1 | 9.5 |
| ABS resin | 10 | 10 | 5 | Comparative Example | 0.1 | 7.0 |

*Cu: Copper
SNi: Semi-bright nickel plating
BNi: Bright nickel plating
Cr: Chromium plating
*Evaluation numerals shown in the table represent rating numbers.

As described above, the present invention permits the formation of an electroplating film which has micropores and corrosion resistance more excellent than that obtained by a conventional plating method. A sufficient corrosive effect can be obtained even if the thickness of a film is reduced, as compared with conventional films. In addition, since the components of the plating solution can be easily analyzed, the plating bath can be simply controlled. The present invention is therefore useful in the industrial field.

What is claimed is:

1. A nickel plating solution characterized by containing, in solution, nickel or a nickel salt and, in solution, 0.5 to 20 g/l of salt of an element in Group IIa of the periodic table.

2. A copper-nickel-chromium or nickel-chromium bright electroplating method for forming a film with excellent corrosion resistance comprising nickel eutectoid plating with a thickness of 0.2 to 50 μm using as a nickel plating bath a nickel plating solution claimed in claim 1, and chromium plating with a thickness of 0.1 to 1.0 μm.

3. A copper-nickel-chromium or nickel-chromium bright film with excellent corrosion resistance which is formed by a copper-nickel-chromium or nickel chromium electroplating method claimed in claim 2, said film comprising copper and nickel deposits formed on a basis material or a nickel deposit directly formed on a basis material, which has a fine particle layer of a eutectoid having a thickness of 0.2 to 50 μm; and a chromium deposit having a thickness of 0.1 to 1.0 μm and micropores in the surface thereof.

4. A nickel plating solution according to claim 1, wherein said salt of an element in Group IIa of the periodic table is a strontium salt or a calcium salt.

5. A nickel plating solution according to claim 1, wherein a nickel plating solution containing a nickel salt is a Watts bath or a Weisberg bath.

* * * * *